United States Patent [19]

Fischer

[11] Patent Number: 4,512,123

[45] Date of Patent: Apr. 23, 1985

[54] HIGH-PRESSURE PACKING DEVICE FOR INJECTING SYNTHETIC RESIN INTO CRACKS IN CONCRETE

[76] Inventor: Artur Fischer, Weinhalde 34, D-7244 Tumlingen/Waldachtal 3, Fed. Rep. of Germany

[21] Appl. No.: 459,616

[22] Filed: Jan. 20, 1983

[30] Foreign Application Priority Data

Feb. 5, 1982 [DE] Fed. Rep. of Germany ..... 3203871

[51] Int. Cl.[3] ..... E02D 5/18

[52] U.S. Cl. ..... 52/173 R; 52/514; 52/744; 405/269

[58] Field of Search ..... 52/173 R, 514, 744, 52/704, 749; 405/269

[56] References Cited

U.S. PATENT DOCUMENTS 4,382,720 5/1983 Vonach ..... 52/173 R

FOREIGN PATENT DOCUMENTS 3100804 1/1982 Fed. Rep. of Germany ..... 405/269

414360 7/1974 U.S.S.R. ..... 405/269

*Primary Examiner*—J. Karl Bell

*Attorney, Agent, or Firm*—Michael J. Striker

[57] ABSTRACT

A high-pressure packing device for injecting hardenable synthetic resin into cracks in concrete includes a sleeve of plastics to be wedged into a hole drilled in concrete in the region of the crack and an injection needle attached to the sleeve. The outer surface of the sleeve is formed with grooves starting from the front end face of the sleeve and extended axially of the sleeve to permit the synthetic resin injected into the base of the hole through the sleeve to rise along the grooves towards the crack in concrete to seal the crack.

2 Claims, 1 Drawing Figure

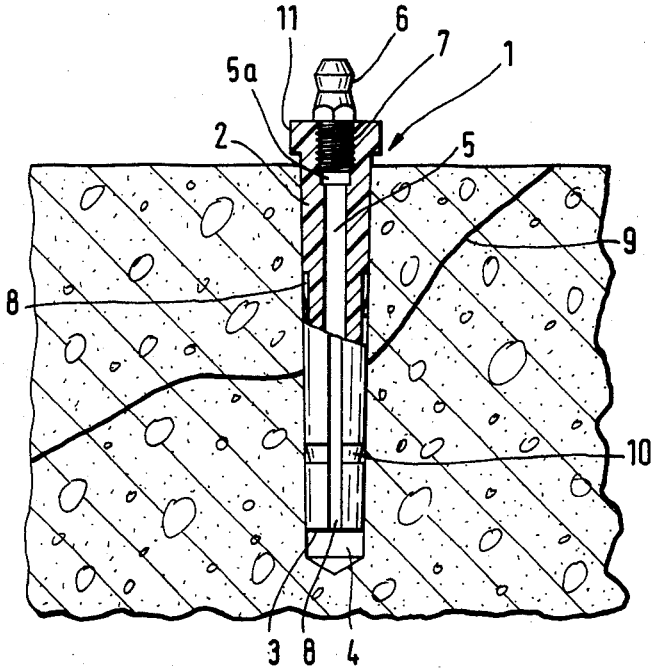
11
6
7
1
5a
2
5
9
8
10
3
8
4

HIGH-PRESSURE PACKING DEVICE FOR INJECTING SYNTHETIC RESIN INTO CRACKS IN CONCRETE

BACKGROUND OF THE INVENTION

The invention relates to a high-pressure packing device for injecting hardenable synthetic resin into cracks in concrete.

Injection devices of the type under consideration include a sleeve which is inserted into a hole drilled in concrete and an injection nipple which can be attached to the sleeve at its rear end, through which nipple hardenable synthetic resin is injected through an internal bore of the sleeve to the base of the drilled hole.

The outer surface of the high-pressure packing means can be tapered in such a manner that approximately $\frac{1}{4}$ to $\frac{1}{3}$ of the length of the packing device can be pushed by hand into the drilled hole which has been made in the concrete. Then, using a hammer, the high-pressure packing sleeve, which has not yet been provided with the injection nipple, is driven completely into the drilled hole. As a result, the sleeve is adequately wedged in the drilled hole so that, even in the case of high-pressure injection, the packing device is not pushed out of the drilled hole. For injection of the hardenable synthetic resin, once the packing device has been inserted into the drilled hole the injection nipple is attached to the sleeve, for example by screwing it into the internal bore of the sleeve. When the drilled hole is made, care should be taken that the drilled hole is deep enough to encounter the crack in concrete, since only then is it possible for the crack to be filled. Very often, however the course of the crack, especially if deep in the concrete, cannot be seen from the outer surface of the concrete. There is thus the danger that drilled holes will be made which are unsuitable for injection. Since the suitability of the drilled holes can be determined only by means of a test injection, the known high-pressure packing services give rise to unnecessary additional expenditure in terms of material and time.

SUMMARY OF THE INVENTION

It is an object of the invention to provide an improved high-pressure packing device for sealing cracks in concrete by hardenable synthetic resin.

It is a further object of the invention to provide a high-pressure device for injecting synthetic resin into cracks, which is efficient in use and easy to operate.

These and other objects of the invention are attained by a high-pressure packing device for injecting hardenable synthetic resin into cracks in concrete and insertable into a hole drilled in concrete in the region of a crack, comprising an elongated sleeve of synthetic plastic material having an internal bore, a front end to be positioned near a base of said hole and a rear end, said sleeve having an outer surface tapering towards said front end whereby said sleeve is wedged in said hole; and an injection nipple inserted into said bore at said rear end of the sleeve, said sleeve being formed with a plurality of longitudinal grooves formed in said outer surface and starting from said front end and extended in the direction of elongation of said sleeve whereby the synthetic resin injected through said nipple into said bore flows into said base and then rises along said grooves towards the crack to seal the latter when hardened.

The grooves may be spaced from each other in a circumferential direction.

The sleeve may be formed with at least one additional circumferential groove formed in said outer surface and extended between two adjacent grooves.

The sleeve may be further provided with a flange at its rear end, said flange forming a stop for a hammer to be used for inserting the sleeve into the drilled hole.

As a result of the proposed device, even drilled holes made such that the crack in concrete meets the wall of the drilled hole in the region of the outer surface of the sleeve are suitable for injection. When the synthetic resin is injected, it fills first the base of the drilled hole, which is not in contact with the crack, and then rises in the grooves which start from the front end face of the sleeve. The synthetic resin is then able to penetrate the crack in the concrete via that groove which meets the crack in the concrete. Injection is carried out using pressures of up to 450 bar. Filling the cracks on the one hand restores the original compressive strength of the concrete and, on the other hand, closes up and seals cracks.

The circumferential groove formed in the sleeve, on the one hand, produces a connection between the axial grooves and, on the other hand, provides a further possibility for guiding synthetic resin immediately towards cracks, especially cracks which intersect the wall of the drilled hole in the axial direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE of the drawings is an axial and partially sectional view of the high-pressure packing device according to the invention.

DETAILED DESCRIPTION OF THE PREFERRED EMBODIMENTS

The high pressure packing device generally denoted as 1 comprises a sleeve 2 formed of synthetic plastic material and having an elongated internal bore 5. The outer surface of sleeve 2 tapers towards the front end 3 of the sleeve. The tapering of the sleeve outer surface is so selected that the sleeve is wedged in a drilled hole 4 when it is driven into the hole by hand or by hammer or by both. When inserted into the hole 4 the high-pressure packing device is in position to absorb the pressure occuring during the injection of synthetic resin. An injection nipple 6 is screwed into the internal bore 5 of sleeve 2, which bore widens slightly in the region of its rear once sleeve 2 has been hammered into the drilled hole. To ensure an adequate hold of the injection nipple 6 in bore 5 the diameter of the enlarged portion 5*a* is selected to correspond approximately to the minor diameter of the external thread 7 of injection nipple 6. The enlarged portion 5*a* of bore 5 also weakens the sleeve 2 in its rear region so that sleeve 2 can be hammered off flush with the outer surface of concrete after synthetic resin has been injected and hardened.

According to the invention sleeve 2 is provided with a number of longitudinal grooves 8 formed in its outer circumferential wall and extended in the axial direction.

Grooves 8 are circumferentially spaced from each other and start from the front end 3 of the sleeve.

When synthetic resin is injected it fills through bore 5 the base of the drilled hole 4,which base is not in contact with a crack 9. From the base of hole 4 unhardened synthetic resin rises along the grooves 8 towards the crack and penetrates the crack in concrete. Thus grooves 8 permit the synthetic resin to rise during the injection process so that sealing of the crack can be effected even if the crack 9, as shown in the drawing, intersects the wall of the drilled hole in any region of the outer surface of sleeve 2 outside the base of hole 4.

The sleeve 2 can be further provided with circumferental grooves 10 which extend to connect the spaced axial grooves 8 to each other. Grooves 10 which also receive the synthetic resin guided in the grooves 8 transmit the synthetic resin to the possible cracks which encounter the wall of the drilled hole in the axial direction.

Furthermore, sleeve 2 is provided with a rim or flange 11, which, on the one hand, acts as a stop during hammering sleeve 2 into hole 4 and, on the other hand, serves the purpose of enlarging the end contact surface for hammering. Although straight axial grooves are shown in the preferred embodiment it is to be realized that grooves 8 can be helical.

It will be understood that each of the elements described above, or two or more together, may also find a useful application in other types of high-pressure devices for injecting synthetic resin into cracks in concrete differing from the types described above.

While the invention has been illustrated and described as embodied in a high pressure packing device for injecting synthetic resin into cracks in concrete, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A high-pressure packing device for injecting hardenable synthetic resin into cracks in concrete and insertable into a hole drilled in concrete in the region of a crack, comprising an elongated sleeve of synthetic plastic material having an axis and an internal bore, a front end to be positioned near a base of said hole and a rear end, said sleeve having an outer surface tapering towards said front end whereby said sleeve is wedged in said hole; and an injection nipple inserted into said bore at said rear end of the sleeve, said sleeve being formed with a plurality of longitudinal guiding grooves formed in said outer surface and starting immediately from said front end and extended in the direction of the axis of said sleeve, said guiding grooves being spaced from each other in a circumferential direction, said sleeve being further formed with at least one additional circumferential groove formed in said outer surface and extended between two said adjacent grooves to connect the longitudinal grooves to each other, whereby the synthetic resin injected through said niple into said bore flows into said base and then is guided along said longitudinal and circumferential grooves and rises towards the crack to seal the crack when hardened.

2. The device is defined in claim 1, wherein said sleeve is formed with a flange at said rear end, said flange forming a stop for a hammer to be used for inserting said sleeve into said hole.

* * * * *